US005087102A

United States Patent [19]

Kiefer

[11] Patent Number: 5,087,102

[45] Date of Patent: Feb. 11, 1992

[54] CONTINUOUS MINING MACHINE

[76] Inventor: Heinz E. Kiefer, 10332 S. 535 East, Sandy, Utah 84070

[21] Appl. No.: 554,273

[22] Filed: Jul. 18, 1990

[51] Int. Cl.[5] ..... E21C 29/26; E21C 31/04

[52] U.S. Cl. ..... 299/72; 299/33; 299/75

[58] Field of Search ..... 299/29, 31, 33, 72, 299/73, 75, 76, 95, 1, 11; 37/DIG. 17

[56] References Cited

U.S. PATENT DOCUMENTS

| | | | |
|---|---|---|---|
| 3,596,997 | 8/1971 | Valatin | 299/72 |
| 4,298,232 | 11/1981 | Mendola | 299/75 X |

FOREIGN PATENT DOCUMENTS

| | | | |
|---|---|---|---|
| 2602015 | 8/1976 | Fed. Rep. of Germany | 299/31 |
| 1288293 | 2/1987 | U.S.S.R. | 299/1 |
| 426966 | 4/1935 | United Kingdom | 299/76 |
| 2144786 | 3/1985 | United Kingdom | 299/33 |

*Primary Examiner*—David J. Bagnell
*Attorney, Agent, or Firm*—Terry M. Crellin

[57] ABSTRACT

A continuous mining machine for excavating a longitudinal shaft or tunnel underneath the surface of the earth. The machine has a working platform that mounted on the transport mechanism, and a cutter platform is mounted to the working platform. The cutter platform pivots on the working platform, such that the cutter platform moves in a reciprocating, arcuate movement around the forward end of the working platform. A cutter member mounted to the cutter platform through a cutter mounting module moves in a reciprocating, linear motion on the cutter platform. The cutter member is capable of performing a forward, backward and circular cutting pattern. The machine is capable of roof bolting operations simultaneous with the cutting operation. The machine is mounted to the transport mechanism to pivot about a vertical axis through the transport mechanism. A lift is provided for lifting the working platform upwardly from the floor of the excavation to support the entire mining machine on the life and suspend the transport mechanism above the floor. The transport mechanism can then be turned and the machine lowered to the floor of the excavation to change the direction of advance of the mining machine.

23 Claims, 3 Drawing Sheets

CONTINUOUS MINING MACHINE

BACKGROUND OF THE INVENTION

1. Field of the Invention

The present invention relates to continuous mining machines for excavating a longitudinal shaft or tunnel underneath the surface of the earth. In particular, the invention relates to such machines which have improved cutting means for advancing the shaft, wherein the cutting means moves in an arcuate path from one side of the machine to the other at the forward end of the machine. The invention further relates to such machines which have improved transport means for advancing the machine over the floor of the shaft such that the machine can be abruptly turned in place to change the direction of advance of the machine to any desired, new direction.

2. State of the Art

All continuous mining machines of the prior art can be categorized as full face machines or partial face machines. Full face machines sump into the face of the excavation by moving the whole machine forward to advance the cutting means into the face of the excavation by the depth of the cutting means. Full face machines of the prior art may utilize angled advance of the cutting means into the advancing face of the excavation or they may sump the cutting means perpendicularly into the face. After the cutting means has been sumped into the face of the excavation, it is then moved sideways and up and down to extract the intended width and height of the shaft which is being excavated. The main frame on which the cutting head is mounted remains in place until the cutting depth of the advancing face has been fully extracted. The machine is then moved one web forward, and the cutting cycle is repeated. Partial face machines are similar in most respects to full face machines, but can only cut approximately their own width at one time. The width of these machines is less than that of the advancing face of the excavation. Thus it is necessary to move the partial face machines repeatedly forward, backward and sidewards in order to open the full width of the advancing face of the excavation.

Long boom type cutting heads, usually mounted on Caterpillar type tractors, have commonly been used in mining machines of the prior art. The boom moves up and down and laterally back and forth to extract the face of the shaft or tunnel being excavated. Drilling or boring type cutting heads that can be moved up and down and laterally back and forth relative to the main frame of the machine have also been used on machines of the prior art. As mentioned previously, full face machines extract the full width of the shaft or tunnel with each advance of the machine, whereas partial face machines must be maneuvered back and forth to extract the full width of the shaft or tunnel.

Full face machines suffer from various disadvantages depending on their specific design. Various disadvantages are inherent in all full face machines of the prior art which hamper efficient operation of the machines and restrict the machines from being true continuous mining machines.

The necessity to move the main frame of the machines during the sumping portion of the extraction cycle and the massive size of the machines prevent integration of roof support functions, such as roof bolting, simultaneous with the mining function. The massive size of the cutting units as well as the machines as a whole do not allow roof support operations to be performed simultaneously with the mining operations even in the portion of the extraction cycle when the main frame of the machines is stationary.

Further, the massive dimensions of the machines of the prior art do not allow roof support operations to be readily performed at desired proximity of the advancing face of the excavation even when the mining function of the machines is idled. As a result, the mining machine must not only be idled, but it must be moved back from the face of the excavation for roof support operations to be performed.

Experience has shown that so called continuous miners of the prior art deserves that name at most only about seventy percent of the time. They remain idle the rest of the time due to roof support tasks that must be carried out while the machines are idle.

Another disadvantage of the prior art machines is that their design and massive dimensions do not allow for ease of turning the machines into different cutting directions, e.g., into crosscuts. Considerable maneuvering and/or costly disassembly is required if a change in cutting directions is desired. The maneuvering of the massive machine often results in miring of the machine into the floor of the excavation. If the machine becomes mired in the floor, extensive time and effort is required to extricate the machine from the depression that it itself has produced. The inefficient and time consuming operations involved in turning the mining machines of the prior art in a new direction, such as when a crosscut is to be made, when added to the idle time required for roof support functions greatly restrict the productivity of the machines.

Uneven and irregular cutting patterns inherent with the prior art machines further create irregular ribs at the sides of the excavation. The irregular ribs represent injury hazards, and work intensive cleanup is often required because of sloughing of the ribs. In addition, gas and dust control is minimal with the prior art machines. The design of the machines are not conducive to controlling gas and dust created in the area of the cutting operation so as to limit migration of dust and gas from the area of the cutting operation.

Partial face machines, though having somewhat higher mobility than full face machines because of their somewhat reduced size, still have all the disadvantages of full face machines as discussed above. Integration of roof support operations with the mining operations is unfeasible because of the excessive maneuvering of the machines during mining. The almost constant maneuvering of the partial face machines results in excessive damage to the floor of the excavation. This causes severe utilization problems when the floor becomes damaged to the point that the machine becomes mired and stuck. High maintenance demands, especially in the presence of water, are made in freeing mired machines as well as repairing the floor of the excavation for other purposes.

Examples of so called continuous mining machines as disclosed in the patent literature are shown in the following U.S. Pat. Nos. 4,770,469; 4,740,037; 4,721,340; 4,641,889; 3,498,675; and 2,711,634. These patents were found as a result of a search that was made preliminary to the filing of the application for patent of the present invention. These patents do not show or even remotely suggest the novel improvements of the present invention.

3. Objectives

A principal objective of the invention is to provide a novel mining machine that approaches closely a true continuous mining machine which is capable of integrating roof supporting operations with the mining function, so that roof support and mining operations can be carried out substantially simultaneously.

A particular objective of the present invention is to provide such a machine which has cutter means that moves in an arcuate motion about the forward end of the machine and from one side of the machine to the other side to cut an advance cut of set depth in the face of the excavation while the main frame of the machine remains stationary, such that roof supporting functions can be undertaken from the main frame of the machine simultaneously with the cutting of the advance cut in the face of the excavation.

Another objective of the present invention is to provide such a novel mining machine in which the cutter means moves in an arcuate motion about the forward end of the machine and is further adapted to move in a linear motion parallel to the direction of advance of the excavation when the cutter head is at the opposite sides of the machine, whereby substantially straight ribs can be cut at the sides of the excavation.

A further objective of the present invention is to provide such a novel mining machine that is adapted to cut a full width in the advancing face of the excavation without requiring elaborate maneuvering other than forward movement to accomplish the next subsequent cut in the advancing face of the excavation.

A still further objective of the present invention is to provide such a novel mining machine having means to facilitate quick, abrupt changes in the direction of mining, such as to develop a crosscut entry, without requiring multiple forward and reverse movements of the machine so as to avoid the waist of time in accomplishing the change in direction as well as to avoid undue damage to the floor of the excavation caused by such repeated forward and reverse movements.

An additional objective of the present invention is to provide such a novel mining machine having means for providing temporary support to the roof of the excavation immediately above the mining machine while also allowing installation of roof bolts as closely as possible to the advancing face of the excavation.

Another objective of the present invention is to provide such a novel mining machine having means for separation of the mining and working areas on the machine with a protective divider to provide for dust and gas control in the working areas of the machine.

BRIEF DESCRIPTION OF THE INVENTION

The above objectives are achieved in accordance with the present invention by providing a novel mining machine that approaches very nearly being a true continuous miner. The novel apparatus of the present invention comprises an advancing mechanism, such as a continuous track assembly commonly referred to as a Caterpillar drive. The advancing mechanism supports a subframe on which a working platform or turntable is mounted. This turntable can pivot around a vertical pivot axis extending through the machine. The turntable can pivot through a complete circle or any portion thereof.

A cutting unit is carried on the turntable. The cutting unit comprises a cutter platform mounted to the turntable. Means are provided for moving the cutter platform in a reciprocating, arcuate movement around the forward end of the turntable between opposite sides of the turntable. The cutting unit further comprises a shearing assembly that includes an electric or electro-hydraulic motor, a cutting drum and drive means for driving the drum by the motor. The cutting drum is mounted to extend outwardly from the cutting unit to engage the face of the excavation when the cutting unit is moved by the movement of the cutter platform. Preferably, the cutting platform moves on an arcuate track or guide about the forward end of the turntable.

The cutting unit is mounted to the cutting platform through a cutter mounting module associated with the cutting platform, and means are provided for moving the cutter mounting module in a reciprocating, linear motion on the cutting platform. The linear motion of the cutter mounting module is in a direction that is perpendicular to a radial line extending from the pivot axis of the arcuate movement of the cutter platform. The length of the linear motion of the cutter mounting module can vary, depending on the depth of cut, i.e., the distance advanced during one web cycle of the cutting unit. The depth of cut will be in accordance with the roof support criteria for the specific excavation. The length of the linear motion of the cutter mounting module is also dependent on the width of the shaft or tunnel being excavated.

In operation, the mining machine is moved to a position adjacent to the face of the excavation, with the cutter mounting module positioned adjacent one of the side ribs of the excavation. The cutter mounting module is then moved along its linear motion to advance the cutter drum into the face of the excavation to extend the rib on the side of the excavation. After the rib extension has been cut, the mounting module is brought to a position so that the trailing side of the cutter drum is in alignment with a line perpendicular to the side rib and passing through the pivot axis of the cutter platform. The cutter platform is then moved in its arcuate motion whereby the cutter drum cuts an arcuate advancing cut into the face of the excavation. When the arcuate, advancing cut has been made, the cutter mounting module is again moved in its linear movement, whereby the cutter drum forms the straight rib on the other side of the excavation.

The cutter drum is advantageously of a substantially large size compared to cutting devices of the prior art continuous miners. The drum will generally have a diameter which is up to about 60% of the height of the excavation being formed. In practice, the drum can have a diameter ranging anywhere from about two feet to about eight feet. Means are preferably provided for raising and lowering the drum vertically so that by making two cuts, a lower one and a higher one, across the face of the excavation, an entry of desired height can be obtained. The thickness of each cut made by the drum is dependent on the longitudinal length of the drum. Advantageously, the longitudinal length of the drum can be about the same as the diameter of the drum but can, of course, be smaller or larger than the diameter of the drum depending upon the characteristics of the excavation being formed.

It is advantageous to make two cuts across the face of the excavation. At the beginning of the cutting cycle, with the cutter mounting module positioned at one side rib of the excavation, the drum is raised to the roof level and the machine is moved forward to be adjacent the face of the excavation. The cutter mounting module moves linearly forward and the cutter drum cuts an upper segment of the rib adjacent to the roof. The drum is then lowered and the cutter cuts downwardly to the floor. The cutter mounting module then moves linearly backward and the drum cuts the floor level cut along the rib. The entire mining machine is now moved forward, and the cutter drum is raised to roof level. The turntable is now pivoted about its pivot axis so that the cutter drum cuts an arcuate cut at roof level into the face of the excavation. When the cutter drum reaches the other side rib it is lowered and can be moved in the linear motion of the cutter mounting module to form a straight rib at the other side. Then, with the drum in its lowered position, the turntable moves back so that the cutter drum cuts an arcuate floor level cut into the face of the excavation. The cutting cycle is then repeated to advance the entry into the face of the excavation.

Because the cutter drum extends radially outwardly from the forward end of the turntable or working platform, adequate space is available for positioning roof bolting means on the working platform for installing roof bolts in the roof of the excavation in the area above the mining machine. The turntable or working platform does not move during the cutting operation, and thus the bolting of the roof adjacent to the face of the excavation can take place simultaneously with the cutting of a new swath or web in the face of the excavation. By employing roof bolting apparatus mounted to the turntable or working platform of the mining machine of the present invention, a completely supported roof is provided for the excavation immediately above and/or behind the machine. The roof of the excavation is properly supported in the area above the mining machine and very close to the advancing face of the excavation. There is no idle time required for the mining machine to accommodate roof support operations. The only time that the present machine is not employed in mining material from the advancing face of the excavation is the short period in which the machine is moved forward toward the face between cutting cycles.

In a preferred embodiment of the invention, means are provided which cooperate with the transport mechanism of the machine to lift and carry the complete machine off the floor of the excavation. With the transport means suspended above the floor of the excavation, it can be turned relative to the rest of the machine so that the direction of the transport means can be changed to any new direction while the machine proper remains in place relative to the floor of the excavation. When the transport means is set in its new direction, the machine proper is lowered to again rest on the transport means on the floor of the excavation.

The turntable or working platform of the machine is then pivotally moved about the pivot axis so that the forward end of the turntable is directed in the new direction of the transport means. The mining machine accordingly has had its direction changed in place without moving forward or backward relative to the floor. By eliminating repeated forward and backward movements of the transport means during the change in direction, the floor is not damaged and the machine does not become mired in the floor even in wet working conditions. The pivoting movement of the turntable of the machine of the present invention is also advantageous when repairs are needed to an inaccessible portion of the machine. The machine can be turned by turning the turntable to where the area requiring repairs is more accessible.

Preferably, the means for lifting and carrying the machine off the floor of the excavation comprises a massive, double acting, hydraulic cylinder that is extendable from both ends thereof and located coaxial with the vertical axis through which the turntable pivots relative to the transport means. The lower end of the telescoping cylinder is moveable downwardly through an opening in the transport means to abut the floor of the excavation and to lift the machine upwardly from the floor. The upper end of the telescoping cylinder is moveable upwardly to contact the roof of the excavation and stabilize the mining machine as the machine is lifted from the floor of the excavation.

The upper end of the telescoping cylinder advantageously serves another purpose. A roof support canopy can be attached to the upper end of the telescoping cylinder. The roof support canopy can be pushed upwardly against the roof of the excavation to provide temporary support of the roof over the mining machine. The canopy can also be used to suspend a curtain around the inner periphery of the cutting pattern of the cutter drum. The curtain provides excellent means for dust and gas control so as to thereby keep the work area free from hazardous gasses and dust.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
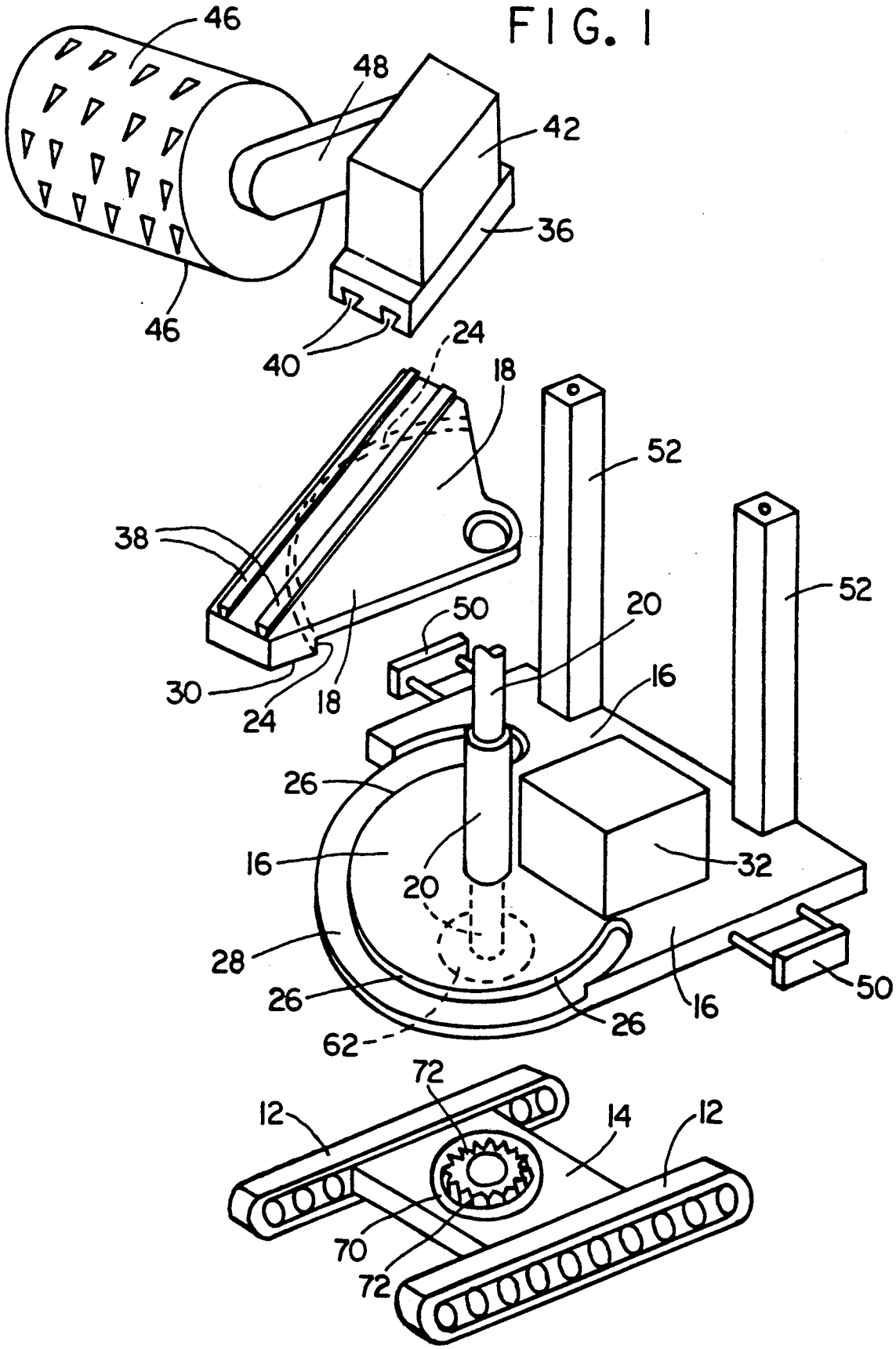
FIG. 1 is an exploded pictorial representation of a preferred embodiment of a continuous mining machine in accordance with the present invention.

Referring to the drawings, there are shown two very similar embodiments of novel, continuous mining apparatus in accordance with the present invention. Each of the embodiments illustrates apparatus that is an essentially true continuous mining machine for excavating longitudinal shafts or tunnels underneath the surface of the earth. In the embodiment shown in FIG. 1, the cutting drum is adapted to move in an arc of up to 180 degrees. In the embodiment shown in FIG. 2, the cutting drum cuts from one side of the machine to the other by first moving in an arc of 90 degrees from the first side of the machine which is adjacent one side rib of the excavation to a position in front of the machine. The cutting drum then extends in a linear motion to the opposite side of the machine and the other side rib of the excavation. The difference in the operation of the two embodiments will be discussed further hereinafter.

The construction of the two embodiments is very similar and will be discussed using the same reference numerals for like parts of both embodiments. The continuous mining machine of the present invention as shown in both embodiments of the drawings comprises a transport means for moving the machine over a floor of the shaft or tunnel that is being excavated. As illustrated, the transport means comprises a pair of continuous tracks 12 and a subframe 14 connected between the tracks 12. It should be recognized however that the transport means could just as well be any known means of moving an apparatus forward in a linear direction. The transport means could be of the type that moves on wheels, rails or skids.

A working platform 16, also referred to previously as a turntable, is provided having forward and trailing ends and opposite sides. The working platform 16 is mounted on the transport means. As will be explained hereinafter, the working platform 16 is preferably mounted to the transport means for pivotal movement about a vertical axis through the transport means.

A cutter platform 18 is mounted to the working platform 16, and means are provided for moving the cutter platform 18 about a pivot point on the working platform 16, such that the cutter platform 18 moves in a reciprocating, arcuate movement around the forward end of the working platform 16 and between the opposite sides of the working platform 16.

As illustrated, the cutter platform 18 comprises a plate having a perimeter shape substantially of an isosceles triangle. The cutter platform 18 is pivotally connected to the working platform 16 at the corner formed by the substantially equal sides of the triangular shaped plate. The pivotal connection is advantageously made to a massive, hydraulic cylinder 20 that will be discussed further hereinafter. The hydraulic cylinder 20 extends vertically upward from the working platform 16, and a circular opening in the cutter platform 18 is received coaxially over the hydraulic cylinder 20. Bearing means as well known in the art is provided about the opening in the cutter platform 18 such that the cutter platform can rotate in a pivoting movement about the hydraulic cylinder 20.

A circular flange or lip 24 is provided extending from one leg of the triangular plate of the cutting platform 18 to the other leg, with the arcuate lip 24 having a center point coinciding with the central, vertical axis of the hydraulic cylinder 20. An arcuate track 26 extends from one side of the working platform 16 to the other at the forward end of the working platform. The lip 24 slides along the track 26 as the cutting platform 18 pivots and moves relative to the working platform. Arcuate bearing surfaces 28 and 30 are provided on the working platform 16 and cutting platform 18 for support of the cutter platform 18 on the working platform 16 and for sliding motion of the cutter platform 18 relative to the working platform. A motor 32 is provided for powering the movement of the cutter platform 18. Appropriate drive means, which are commonly known in the art and therefore not shown in the drawings, is provided to cooperate with the motor for moving the cutter platform 18 in its arcuate movement. For example, a chain drive or a rack and pinion could be coupled to the motor to drive the cutter platform 18 in its arcuate movement.

A cutter mounting module 36 is connected to the cutter platform 18, and means are provided for moving the cutter mounting module 36 in a reciprocating, linear motion on the cutter platform 18. The linear motion of the cutter mounting module 36 is in a direction that is perpendicular to a radial line extending from the pivot axis of the arcuate movement of the cutter platform 18. As illustrated, the means for moving the cutter mounting module 36 in its linear motion comprises a pair of dovetail type tracks 38 extending along the third side of the triangular plate of the cutting platform 18. A matching pair of dovetail shaped slots 40 extend along the underside of the cutter mounting module 36 for reception of the tracks 38. The slots 40 are adapted to make sliding movement back and forth along the tracks 38. A motor 42 is provided for powering the cutter mounting module 36 in its motion along the tracks 38.

A cutter member 46 is mounted to the cutter mounting module 36 to extend outwardly from the cutter mounting module 36, the cutter platform 18 and the working platform 16. As illustrated, the means for mounting the cutter member 46 to the cutter mounting module 36 comprises a ranging arm 48 having first and second ends. The ranging arm 48 is pivotally attached adjacent its first end to the outer peripheral side of the cutter mounting module 46 so that the ranging arm can pivot up and down about a pivot axis that is perpendicular to the direction of the reciprocating, linear motion of the mounting module 36. The cutter member 46 is mounted to the second end of the ranging ar 48 to extend outwardly from the ranging arm 48 in a direction away from the cutter mounting module 36. The cutter member 46 is preferably a cylindrical drum pivotally mounted to the ranging arm 48 to rotate about the cylindrical axis of the cutter drum 46, with cutting bits laced in the cylindrical side of the cutter drum. The cutter drum 46 is rotated about its axis by a transmission system housed in the ranging arm 48 and driven by the motor 42.

Figure 2:
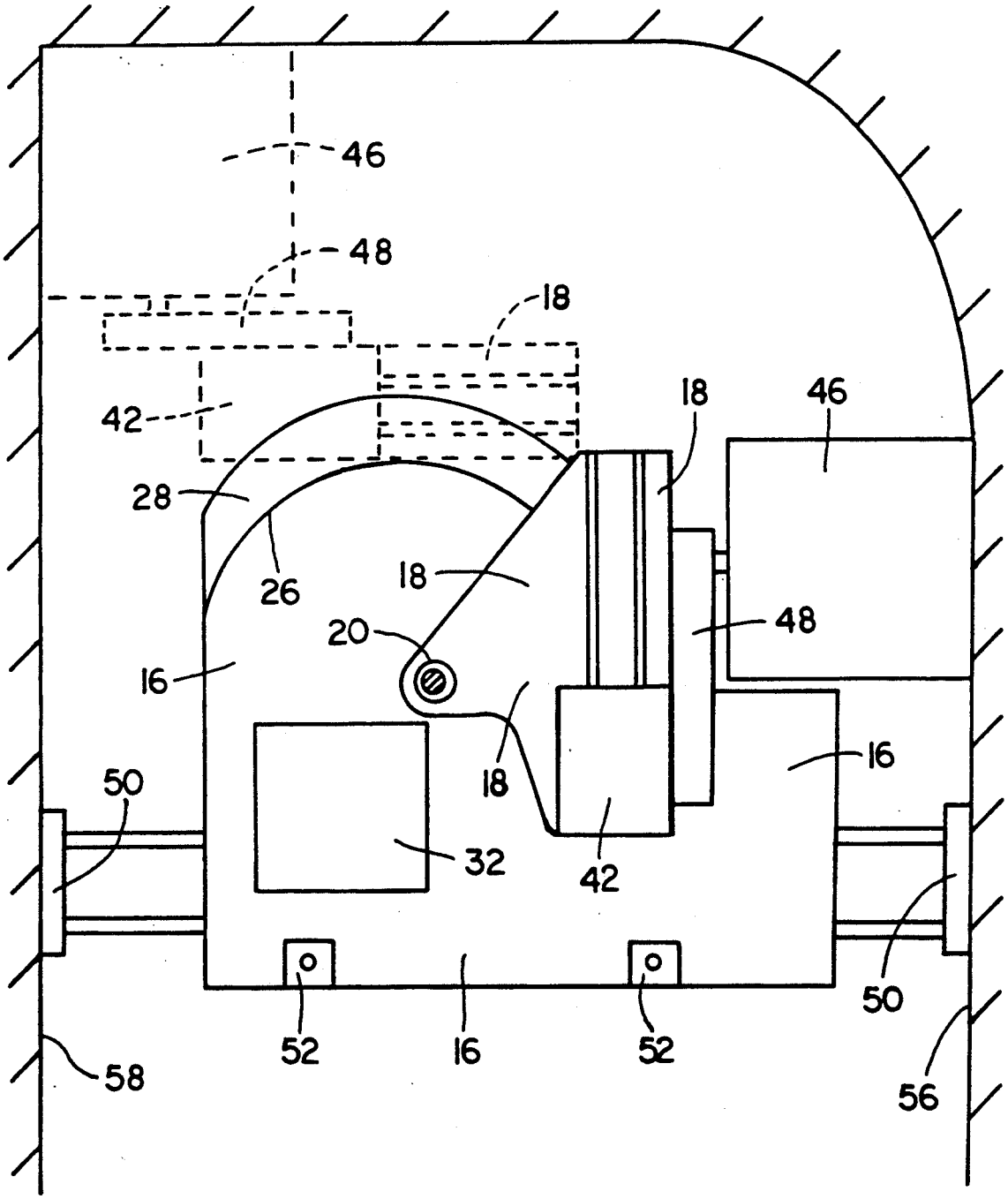
FIG. 2 is a top plan view of a machine in accordance with the present invention showing the cutter drum at the end of its cutting cycle and adjacent to one of the side ribs of the excavation.
Figure 3:
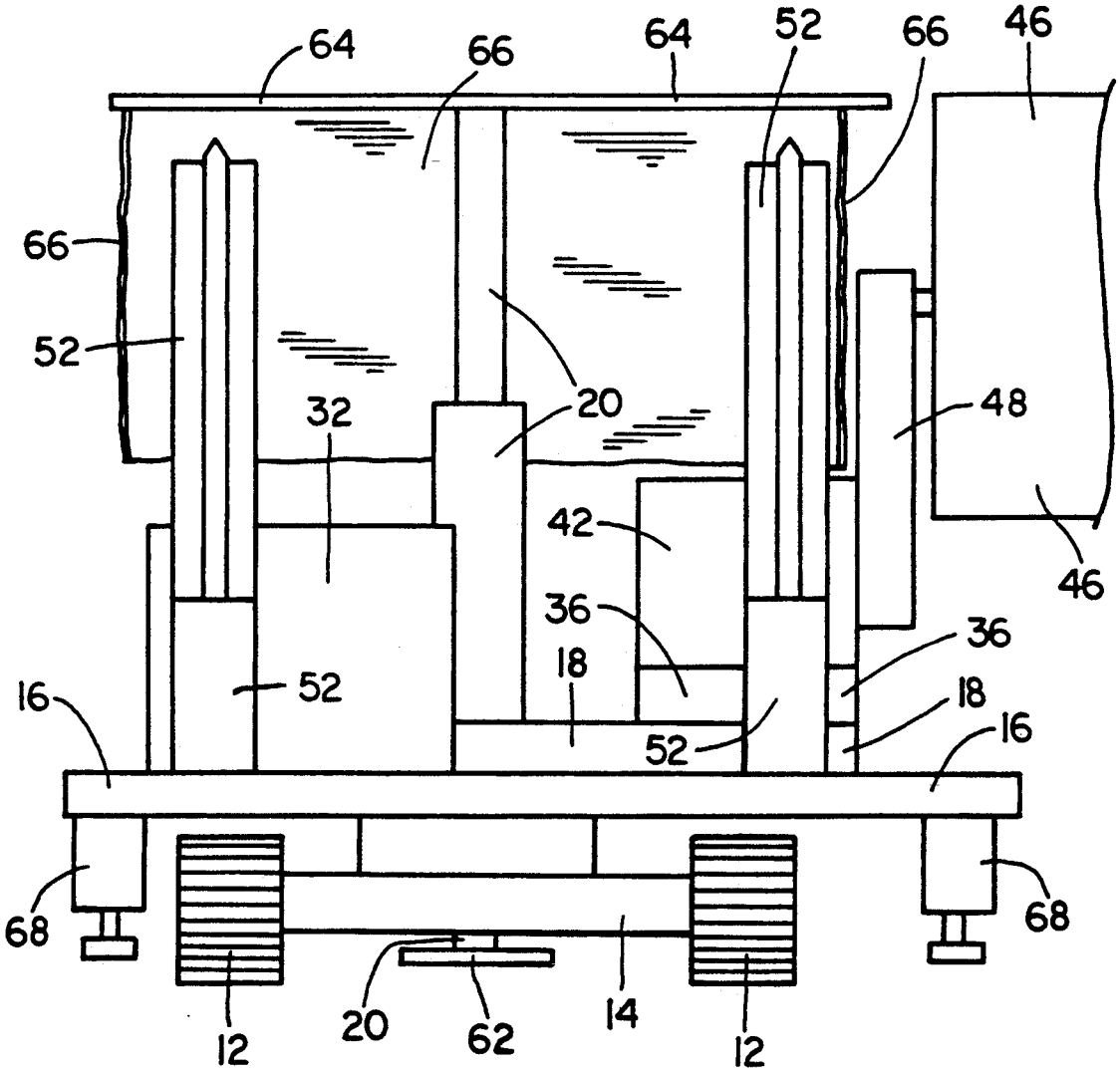
FIG. 3 is a rear elevation view of the machine of FIG. 2 taken along line 2—2 of FIG. 2.

As best shown in FIG. 2, when the cutter platform 18 and the cutter mounting module 36 are positioned at a terminal position in the arcuate movement of the cutter platform 18, with the cutter drum 46 adjacent one side of the excavation, the cutter mounting module 36 can move in the reciprocating, linear motion thereby advancing the cutter drum 46 in a substantially straight rib cut at the side of the excavation, and when the cutter platform 18 moves in its arcuate movement, the cutter drum 46 cuts an advancing, arcuate cut into the face of the excavation at the forward end of the working platform 16.

Roof bolting means are preferably associated with the working platform 16 for installing roof bolts in the roof of the excavation in the area immediately above the mining machine during the same time that the cutter member 46 is cutting the advancing rib cut and arcuate cut into the face of the excavation. Such roof bolting means are customary in the prior art and are shown schematically by the reference number 52 in the drawing. Only two roof bolting members 52 are shown in the drawings, but it noted that the actual number of roof bolting members 52 and their placing varies with rock formation in which the excavation is being made. It is conventional in coal mining to place roof bolts every four feet. Thus, for an entry having a width of 20 feet, up to six roof bolts may be used. The desired number of roof bolting members 52 could be placed along the mining machine at desired spacings instead of the two shown in the drawings.

Bracing members 50 are also provided at the opposite sides of the apparatus. The bracing members are adapted to be extended to abut the opposite side ribs of the excavation thereby stabilizing the mining machine as the cutter member is cutting the advancing rib cut and arcuate cut into the face of the excavation. The bracing members 50 can further be retracted to form guides that slide along the side ribs of the excavation when the mining machine is moved forward. This ensures straight entry development of the excavation. As illustrated, the bracing members 50 comprise a pair of hydraulic cylinders that extend outwardly from the opposite sides of the working platform 16. The outward ends of the cylinders are advantageously attached to bumper plates that make contact with the side ribs of the excavation.

The operation of the cutting cycle of the two embodiments of the apparatus as shown in the drawings is very similar. The basic cycle will now be described with respect to the embodiment of the apparatus shown in FIG. 2, with the differences in the operation of the apparatus of FIG. 1 being pointed out in the discussion.

At the position shown in FIG. 2, the apparatus stands at the end of one cycle of its cutting operation and is ready to begin a new cutting cycle. The cutter drum 46 advantageously has a diameter of about four feet such that an entry having a height of up to eight feet can be mined using a double pass of the cutter drum 46 as will now be described. For entry heights greater than eight feet, a larger cutting drum would be used.

To begin the new cutting cycle, the cutter drum 46 is raised to the roof level adjacent to the side rib of the excavation as shown in FIG. 2. The cutter mounting module 36 is then moved forward in its linear motion by a distance at least as great as the diameter of the cutter drum 46, and the cutter drum cuts a straight rib cut at the roof level as the cutter mounting module 36 moves forward. At the end of the forward motion of the cutter mounting module 36, the cutter drum 46 is lowered to floor level, and the cutter mounting module 36 is moved back along its linear motion to its starting position. This completes the advancing side rib 56 at the right side of the excavation.

Stabilizing braces 50 are withdrawn slightly so that they can slide along the ribs of the excavation, and the entire machine is advanced with the transport means toward the face of the excavation by a distance equal to about the diameter of the cutter drum 46. In embodiments of a machine incorporating a canopy 64 and foot plate 62 as will be further discussed hereinafter, the canopy 64 and the foot plate 62 are withdrawn slightly from the roof and floor, respectively, before the machine is moved forward. Following advancement of the machine, the stabilizing braces 50 are extended to make firm contact with the ribs of the excavation and hold the machine in a firm, stable condition. If the machine has a canopy 64 and foot plate 62, they are extended to make firm contact with the roof and the floor, respectively.

The cutter drum 46 is raised to the roof level prior to or at the end of the advance movement of the machine by the transport means. The cutter platform 18 then begins its arcuate movement about the forward end of the working platform 16 of the machine, and the cutter drum 46 cuts a roof level, arcuate cut into the face of the excavation. In the embodiment of the machine as shown in FIG. 2, the cutter platform 18 moves through an arc of 90 degrees and stops. At this point, the cutting face of the cutter drum 46 is parallel with the side ribs of the excavation and displaced by the diameter of the drum 46 from the left rib 58 of the excavation. It should be noted that the pivot axis of the cutter platform 18 of the embodiment of FIG. 2 is not along the center line of the machine, but rather displaced toward the left hand side of the machine.

At the end of the 90 degree movement of the cutter platform 18, the cutter mounting module 36 is moved forward in its linear movement. This advances the cutter drum 46 to the left rib 58 of the excavation. The cutter drum 46 is then lowered to cut the straight advancing side of the left rib 58. The cutter mounting module 36 then moves backwardly to its starting position, with the cutter drum 46 cutting the floor level portion of the advancing cut. In the embodiment as shown in FIG. 2, the left hand rib 58 has curved fillets where it joins the floor and roof of the excavation. These fillets can be cut out and removed, if desired, using supplemental apparatus.

When the cutter mounting module 36 returns to its starting position, the cutter platform 18 moves backwardly along its arcuate movement to its starting position, with the cutter drum 46 completing the advancing swath or web of that cutting cycle in the face of the excavation, and the machine is ready to start the next cutting cycle.

In the embodiment of the mining machine shown in FIG. 1, the pivot axis of the arcuate motion of the cutter platform 18 is essentially on the centerline of the working platform 16. The cutter platform 18 moves in an arc of 180 degrees from one side of the machine to the other, and the cutter mounting module 36 is moved in linear motion at the left hand side of the excavation in a manner similar to its movement at the right hand side to cut a straight rib at the left side of the excavation. With the embodiment of the apparatus as shown in FIG. 1, there are no fillets formed at the junctures of the left rib with the roof and floor of the excavation, and there is thus no need for supplemental apparatus to remove such fillets as there is with the embodiment of the machine shown in FIG. 2.

In a particularly preferred aspect of the present invention, means are provided in combination with the transport means of the mining machine for turning the entire machine in place about a vertical pivot axis through the mining machine. In this way, the mining machine can be turned abruptly, in place to cut an entry, such as a crosscut, in a different direction than the main entry. This provision is exceptionally useful in cutting crosscuts as required in most coal mining operations. The machine can be turned very quickly, in place and without damage to the floor of the excavation. The mining machine of the present invention can be turned to make a crosscut in a very small fraction of the time required to make such a turn with continuous mining machines of the prior art.

In this latter embodiment, the working platform 16 is mounted to the transport means to pivot about a vertical axis through the transport means, and means are provided for alternately lifting the working platform 16 upwardly from the floor of the excavation to support the entire mining machine on the lift means and suspend the transport means from the working platform 16 above the floor. The transport means is then pivoted to the new desired direction, and the entire machine is then lowered back to the floor, with the mining machine supported back on the transport means on the floor of the excavation. After the mining machine has been lowered back to the floor, the working platform 16 is rotated on the transport means so that the forward end of the working platform 16 is pointed in the new direction of travel of the transport means. The turning of the mining machine is accomplished very quickly and in place, with no forward or reverse movement of the transport means on the floor of the excavation. The floor of the excavation is not damaged, and the mining machine is ready to begin cutting in the new direction in a very small fraction of the time that is required to change the direction of continuous miners of the prior art.

As shown in the drawings, the transport means comprises a pair of continuous tracks 12 and a subframe 14 on which the working platform 16 is pivotally mounted. The means for lifting and lowering the working platform 16 comprises the double ended telescoping cylinder 20 that is connected to the working platform 16. As mentioned previously, the telescoping cylinder 20 is extendable from both ends thereof and located coaxial with the vertical axis through the subframe 14 of the transport means.

An opening through the subframe 14 of the transport means is positioned coaxial with the vertical axis of the hydraulic cylinder 20 such that the lower end of the telescoping cylinder 20 is moveable downwardly through the opening in the subframe 14 to the floor of the excavation to lift the mining machine, including the working platform 16 and transport means, upwardly from the floor of the excavation. A foot plate 62 can be attached to the lower end of the telescoping cylinder 20 to provide a stable support to contact the floor of the excavation. The upper end of the telescoping cylinder 20 is moveable upwardly to contact the roof of the excavation to stabilize the mining machine as the transport means is lifted from the floor of the excavation.

The pivotal mounting of the working platform 16 to the subframe 14 occurs about the opening in the subframe 14. A bearing and drive means, including such members as the arcuate surface 70 and the drive rack 72 shown in FIG. 1, are provided for operating the tracks 12 and the turning action of the traction unit from the motor 32. It should be recognized that the drive connection involving the bearing and drive means must be capable of supporting the tracks 12 and subframe 14 suspended from the floor. It should further be recognized that a single motor, such as the motor 42 could be provided for supplying all the power requirements of the machine. In such case, the second motor 32 would not be required and additional working space would be provided on the working platform 16.

Advantageously, the upper end of the telescoping cylinder 20 is further provided with a canopy plate 64 that can be pushed upwardly against the roof of the excavation to provide temporary support of the roof over the mining machine. The canopy 64 can also be used to suspend a curtain 66 therefrom around the inner periphery of the movement of the cutter drum 46. The curtain 66 provides separation of the working area of the machine which is occupied by workmen from the cutting operation of the cutter drum 46. Dust and gas generated at the cutter drum is circulated around the curtain 66 and directed away from personnel operating the machine.

The canopy 64 and the foot plate 62 on the opposite ends of the telescoping cylinder 20 provide added stabilization for the machine in addition to that achieved by the side braces 50 during the cutting operations. Outrigger hydraulic cylinders 68 can be provided at the rear corners of the working platform 16 to extend downwardly to the floor of the excavation to further provide stability to the machine during the turning of the machine in a new direction. It should, as a matter of fact, be recognized that three or four outrigger cylinders like those shown by reference numeral 68 could be placed around the perimeter of the working platform 16 of the machine to lift the machine from the floor in the turning operation. With sufficient outrigger cylinders, the downwardly moving end of cylinder 20 would not be necessary to accomplish the turning function. The outrigger cylinders 68 can also advantageously be used to negotiate local undulations and irregularities in the floor of the excavation.

Although preferred embodiments of the mining machine of the present invention have been illustrated and described, it is to be understood that the present disclosure is made by way of example and that various other embodiments are possible without departing from the subject matter coming within the scope of the following claims, which subject matter is regarded as the invention.

I claim:

1. A continuous mining machine for excavating a longitudinal shaft or tunnel underneath the surface of the earth, said mining machine comprising transport means for moving the machine over a floor of the shaft or tunnel that is being excavated;

a working platform having forward and trailing ends and opposite sides, said working platform being mounted on the transport means;

a cutter platform mounted to said working platform;

means for moving the cutter platform about a pivot point on said working platform, such that said cutter platform moves in a reciprocating, arcuate movement around the forward end of said working platform between the opposite sides of said working platform;

a cutter mounting module connected to said cutter platform;

means for moving the cutter mounting module in a reciprocating, linear motion on the cutter platform, with the linear motion being in a direction that is perpendicular to a radial line extending from the pivot axis of the arcuate movement of said cutter platform;

a cutter member; and means for mounting the cutter member to said cutter mounting module to extend outwardly from said cutter mounting module and said working platform, whereby when the cutter platform and the cutter mounting module are positioned at a terminal position in the arcuate movement of said cutter platform, the cutter mounting module can move in said reciprocating, linear motion so that said cutter member cuts an advancing, substantially straight rib cut at the side of the excavation, and when the cutter platform moves in its arcuate movement, the cutter member cuts an advancing, arcuate cut into the face of the excavation at the forward end of said working platform.

2. A continuous mining machine in accordance with claim 1 wherein the transport means comprises a pair of continuous tracks and a subframe on which the working platform is mounted.

3. A continuous mining machine in accordance with claim 1, wherein the means for moving the cutter platform in its reciprocating, arcuate movement comprises an arcuate track at the forward end of the working platform upon which the cutter platform travels.

4. A continuous mining machine in accordance with claim 3, wherein the means for moving the cutter mounting module in its reciprocating, linear motion comprises a linear track on said cutter platform upon which the cutter mounting module travels.

5. A continuous mining machine in accordance with claim 1, wherein the means for mounting the cutter member to said cutter mounting module comprises a ranging arm having first and second ends, said ranging arm being pivotally attached adjacent its first end to the outer peripheral side of said cutter mounting module so that the ranging arm can pivot up and down about a pivot axis that is perpendicular to the direction of the reciprocating, linear motion of said mounting module, with the cutter member being mounted to the second end of said ranging arm to extend outwardly from said ranging arm in a direction away from said cutter mounting module.

6. A continuous mining machine in accordance with claim 5, wherein the cutter member is a cylindrical drum pivotally mounted to said ranging arm to rotate about the cylindrical axis of said drum, with cutting bits laced in the cylindrical side of said cutter drum.

7. A continuous mining machine in accordance with claim 1, further comprising roof bolting means associated with the working platform for installing roof bolts in the roof of the excavation in the area immediately above the mining machine during the same time that the cutter member is cutting the advancing rib cut and arcuate cut into the face of the excavation.

8. A continuous mining machine in accordance with claim 1, further comprising bracing members which can be extended to abut the opposite side ribs of the excavation to stabilize the mining machine as the cutter member is cutting the advancing rib cut and arcuate cut into the face of the excavation, and further which can be retracted to form guides that slide along the side ribs of the excavation when the mining machine is moved forward to thereby ensure straight entry development of the excavation.

9. A continuous mining machine in accordance with claim 1, wherein said working platform is mounted to the transport means to pivot about a vertical axis through said transport means.

10. A continuous mining machine in accordance with claim 9, further comprising means for alternately lifting the working platform upwardly from the floor of the excavation to support the mining machine on the lifting means and suspend the transport means from said working platform above said floor, and then lowering the working platform toward the floor to support the mining machine back on the transport means on the floor of the excavation, whereby the direction of advance of the mining machine on the transport means can be abruptly changed about the vertical axis through said transport means to any desired new direction by (1) lifting the working platform upwardly to suspend the transport means therefrom, (2) rotating the suspended transport means to the new direction, (3) lowering the working platform so that the mining machine is supported on said transport means, and (4) rotating the working platform on the transport means so that the forward end of said working platform is pointed in the new direction of travel of said transport means.

11. A continuous mining machine in accordance with claim 10, wherein the transport means comprises a pair of continuous tracks and a subframe on which the working platform is pivotally mounted.

12. A continuous mining machine in accordance with claim 11, wherein the means for lifting and lowering the working platform comprises a double ended telescoping cylinder connected to said working platform, said telescoping cylinder being extendable from both ends thereof and located coaxial with said vertical axis through said transport means; and an opening through the subframe of the transport means which is coaxial with said vertical axis through said transport means, whereby the lower end of the telescoping cylinder is moveable downwardly through the opening in said subframe to the floor of the excavation to lift the working platform and transport means upwardly from the floor of the excavation, with the upper end of the telescoping cylinder being moveable upwardly to contact the roof of the excavation to stabilize the mining machine as the transport means is lifted from the floor of the excavation.

13. A continuous mining machine in accordance with claim 12 wherein the upper end of the telescoping cylinder is further provided with a canopy plate that can be pushed upwardly against the roof of the excavation to provide temporary support of the roof over the mining machine.

14. A continuous mining machine in accordance with claim 10, wherein the means for moving the cutter platform in its reciprocating, arcuate movement comprises an arcuate track at the forward end of the working platform upon which the cutter platform travels.

15. A continuous mining machine in accordance with claim 14, wherein the means for moving the cutter mounting module in its reciprocating, linear motion comprises a linear track on said cutter platform upon which the cutter mounting module travels.

16. A continuous mining machine in accordance with claim 10, wherein the means for mounting the cutter member to said cutter mounting module comprises a ranging arm having first and second ends, said ranging arm being pivotally attached adjacent its first end to the outer peripheral side of said cutter mounting module so that the ranging arm can pivot up and down about a pivot axis that is perpendicular to the direction of the reciprocating, linear motion of said mounting module, with the cutter member being mounted to the second end of said ranging arm to extend outwardly from said cutter member in a direction away from said cutter mounting module.

17. A continuous mining machine in accordance with claim 16, wherein the cutter member is a cylindrical drum pivotally mounted to said ranging arm to rotate about the cylindrical axis of said drum, with cutting bits laced in the cylindrical side of said cutter drum.

18. A continuous mining machine in accordance with claim 10, further comprising roof bolting means associated with the working platform for installing roof bolts in the roof of the excavation in the area immediately above the mining machine during the same time that the cutter member is cutting the advancing rib cut and arcuate cut into the face of the excavation.

19. A continuous mining mechanism in accordance with claim 1, further comprising bracing members which can be extended to abut the opposite side ribs of the excavation to stabilize the mining machine as the cutter member is cutting the advancing rib cut and arcuate cut into the face of the excavation, and further which can be retracted to form guides that slide along the side ribs of the excavation when the mining machine is moved forward to thereby ensure straight entry development of the excavation.

20. A continuous mining machine for excavating a longitudinal shaft or tunnel underneath the surface of the earth, said mining machine comprising transport means for moving the machine over a floor of the shaft or tunnel that is being excavated;

a working platform having a forward end, said working platform being mounted to said transport means to pivot about a vertical axis through said transport means;

cutter means for cutting an advancing cut into the face of the excavation at the forward end of said working platform;

means for alternately lifting the working platform upwardly from the floor of the excavation to support the mining machine on the lifting means and suspend the transport means from said working platform above said floor, and then lowering the working platform toward the floor to support the mining machine back on the transport means on the floor of the excavation;

said transport means comprises a pair of continuous tracks and a subframe on which the working platform is pivotally mounted;

said means for lifting and lowering the working platform comprises a double ended telescoping cylinder connected to said working platform, said telescoping cylinder being extendable from both ends thereof and located coaxial with said vertical axis through said transport means; and an opening through the subframe of the transport means which is coaxial with said vertical axis through said transport means, whereby the direction of advance of the mining machine on the transport means can be abruptly changed about the vertical axis through said transport means to any desired new direction by (1) moving the lower end of the telescoping cylinder downwardly through the opening in said subframe to the floor of the excavation to lift the working platform upwardly to suspend the transport means therefrom, with the upper end of the telescoping cylinder being moveable upwardly to contact the roof of the excavation to stabilize the mining machine as the transport means is lifted from the floor of the excavation, (2) rotating the suspended transport means to the new direction, (3) lowering the working platform so that the mining machine is supported on said transport means, and (4) rotating the working platform on the transport means so that the forward end of said working platform is pointed in the new direction of travel of said transport means.

21. A continuous mining machine in accordance with claim 20 wherein the upper end of the telescoping cylinder is further provided with a canopy plate that can be pushed upwardly against the roof of the excavation to provide temporary support of the roof over the mining machine.

22. A continuous mining machine in accordance with claim 20, further comprising roof bolting means associated with the working platform for installing roof bolts in the roof of the excavation in the area immediately above the mining machine during the same time that the cutter means is cutting the advancing cut into the face of the excavation.

23. A continuous mining machine in accordance with claim 20, further comprising bracing members which can be extended to abut the opposite side ribs of the excavation to stabilize the mining machine as the cutter means is cutting the advancing cut into the face of the excavation, and further which can be retracted to form guides that slide along the side ribs of the excavation when the mining machine is moved forwardly to thereby ensure straight entry development of the excavation.

* * * * *